United States Patent [19]

Marollaud

[11] Patent Number: 4,474,117

[45] Date of Patent: Oct. 2, 1984

[54] BOILER USING A SOLID GRANULATED FUEL

[76] Inventor: Paul Marollaud, Rue du Bocage, 79440 Courlay, France

[21] Appl. No.: 372,010

[22] Filed: Apr. 26, 1982

[30] Foreign Application Priority Data

Apr. 28, 1981 [FR] France ..... 81 08626
Sep. 4, 1981 [FR] France ..... 81 16971

[51] Int. Cl.[3] ..... F23K 3/14
[52] U.S. Cl. ..... 110/109; 110/290
[58] Field of Search ..... 110/109, 105, 289, 290, 110/293, 286, 300; 414/187, 198; 122/15

[56] References Cited

U.S. PATENT DOCUMENTS 1,688,608 10/1928 Beers ..... 110/290
1,715,961 6/1929 Tschira ..... 110/290
1,736,565 11/1929 Woodcock ..... 110/109
2,377,357 6/1945 Molotzak ..... 110/286
2,563,688 8/1951 Miller ..... 110/105
3,855,950 12/1974 Hughes, Jr. et al. ..... 110/109
4,074,638 2/1977 Miller ..... 110/109

*Primary Examiner*—Edward G. Favors
*Assistant Examiner*—Steven E. Warner
*Attorney, Agent, or Firm*—Frost & Jacobs

[57] ABSTRACT

The invention relates to boilers using solid fuels in granular form.

It comprises: (a) automatic feeding of the firebox with fuel by a reciprocating piston system forming a fire barrier in the rest position and actuated by a low power linear movement motor, and (b) combustion quickened by the supply of blown air and stirred by a system for discharging ashes and combustion residues out of the burner by the action of fingers integral with the piston.

This type of boiler is suited for central heating as well as any other domestic or industrial hot water production.

9 Claims, 4 Drawing Figures

BOILER USING A SOLID GRANULATED FUEL

BACKGROUND OF THE INVENTION

The present invention relates to a hot water boiler using a solid fuel in granular form: coal pellets, various plugs, chips or briquettes of coal, wood, straw, sawdust, ect.(sic) . . .

The known prior art boilers capable of operating with this kind of fuel pose problems of combustion, discharge of ashes or clinker which results in poor heating power and frequent manual operations.

Further, the feeding of these boilers is carried out by an expensive-to-manufacture and difficult-to-operate Archimedes' screw system which requires relatively high motive power.

The present invention has as its object the proposal of a boiler which overcomes the noted drawbacks and which provides, on the other hand, a whole series of advantages: simple design, heat output markedly superior to those of current boilers, a system for automatic feeding, a fire and ash removal of great reliability and low construction cost, and eliminating all manual operations.

SUMMARY OF THE INVENTION

An object of the invention is to provide a boiler which comprises:

(a) an automatic feeding of the firebox with fuel by a reciprocating piston system forming a fire barrier in a rest position and actuated by a low power linear movement motor;

(b) combustion quickened by the supply of blown air and stirred up by the feeding system which itself pokes the firebox.

(c) a progressive and mechanical discharge, out of the burner, of ashes and combustion residues, such as clinker, by the action of fingers integral with the piston.

Another object of the invention is to provide a boiler which comprises an automatic part for feeding the burner from a hopper containing the fuel and by means of a reciprocating double piston forming an integral fire barrier in the rest position and which is actuated by a jack type linear movement electric motor.

Another object of the invention is to provided a boiler which comprises a boiler body of the type having vertical tubular exchangers immersed in a conventional type of water cylinder, but the heating power of which is improved by a removeable domed deflector, the cavity of which may be filled with a charge of refractory material with a view to increasing the thermal inertia.

Another object of the invention is to provide a boiler in which the combustion is improved by the admission of air above the inlet of the burner by a deflector and a high thermal inertia grate.

These features and advantages of a boiler according to the invention will be more apparent from a reading of the detailed description of the embodiments as well as from examining the corresponding attached drawings.

DESCRIPTION OF THE PREFERRED EMBODIMENT

Figure 1:
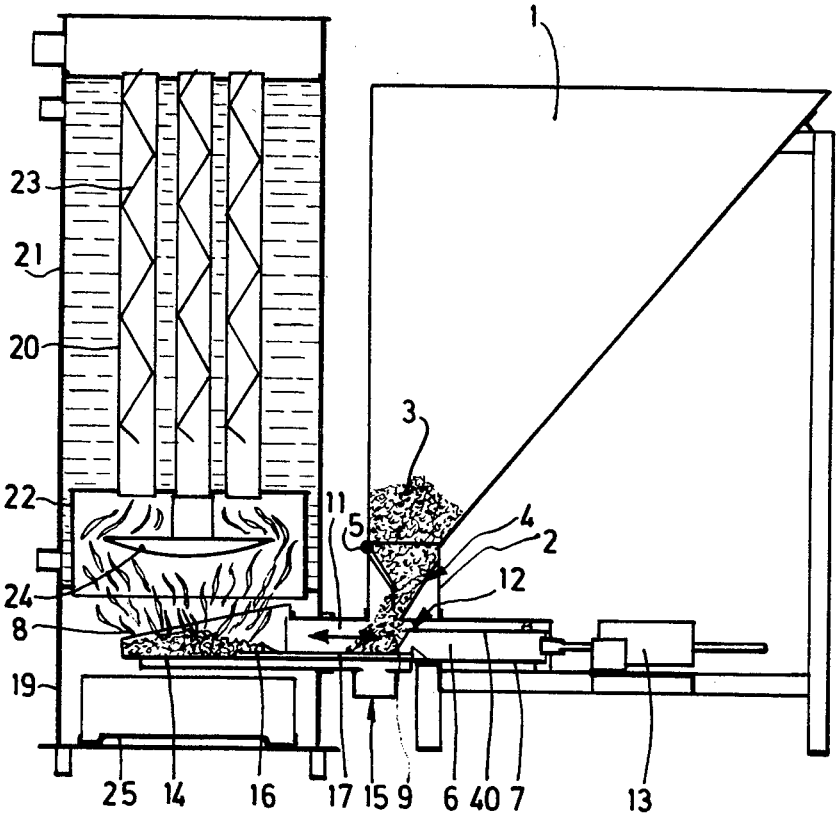
FIG. 1 is a cross sectional view of the boiler showing at its base the burner, the fuel hopper, the piston device for feeding the burner and the blow conduit for activating the fire.
Figure 2:
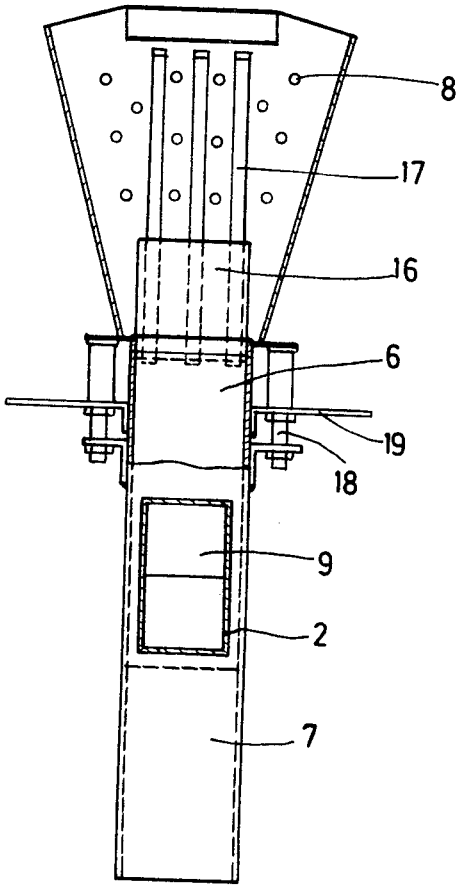
FIG. 2 is a top view, partially in cross-section, of the firebox and the device for feeding the burner and removing the ashes therefrom.

As it is illustrated in FIGS. 1 and 2, a boiler according to the invention, comprises the following separate parts: the automatic feeder, the burner, and the body of the boiler.

The automatic feeder comprises, according to FIG. 1: the storage hopper 1 for the fuel, the feed mechanism, and the drive motor with its control unit or members. This assembly mounted on a tubular frame with adjustable feet (not shown) is connected to the orifice of the burner of the boiler by bolts or other fastening devices. The storage hopper 1 for the fuel is shaped as a truncated pyramid or cone and terminates at its base with a chute 2 adapted to the shape of the hopper and comprises two baffles 3 and 4 limiting the action of the fuel the feed channel. The baffle 3 is at 5 and adjustable for closing the hopper and adapting the admission of fuel to the desired conditions. It is possible to provide the other baffle with a hinge.

The capacity of the hopper 1 may also be increased by adding an extension at its upper part.

According to the invention, the feeding of the firebox is effected by a piston 6 moving in a channel 7 of approximately the same cross-section and driven by a reciprocating movement which ensures the connection between the chute 2 and the burner or grate 8.

In the retracted position, piston 6 uncovers an opening 9 formed in the upper part of channel 7 at the base of chute 2 permitting the fuel to fall by gravity into the channel. The thrust movement of piston 6 drives fuel into burner or grate 8; at the end of its stroke the piston is positioned at the inlet of the burner and forms a fire barrier element.

In order to avoid jamming the piston at the beginning of the thrust, there is provided a space 11 between the top of piston 6 and the top of channel 7. To this end a horizontal shelf 10 of width equal to the channel is integrally formed with the piston along a length at least equal to the stroke of the piston.

During the thrust, a bed of fuel is spread in the space 11 between the shelf 10 and the top of the channel 7. To eliminating any risk of jamming, an abutment 12, fixed at the rear of the opening 9 progressively eliminates the bed of fuel toward the front of the piston during retracting movement thereof.

Driving the feed mechanism is ensured by a motor 13 of the known jack-action type, that is to say that the rotational movement is converted into linear movement by a two-way nut-and-bolt system which is advantageously controlled by any suitable electric or electronic control and command device; the component parts of which are partly or entirely housed in a so-called control panel or box (not illustrated).

The control panel or box advantageously comprises all the suitable security and monitoring control members for the "on" or "off" condition selected and programmed for the desired operation of the boiler as for example; automatic operation with regular or variable feeding intervals the duration of which may be linked to a thermostat control determining the degree of heating of the boiler as a function of the need;

programmed or manual starting up and stopping, and operation with or without the supply of air blown into the burner, etc . . .

The burner 8 illustrated in cross-section in FIG. 1 and in top view in FIG. 2, is advantageously built of stainless steel or steel covered with a refractory lining or any other suitable materials. The width of the inlet is adapted to the width of the feed channel 7. The burner then widens progressively toward the center of the boiler and its bottom is perforated for permitting combustion air by means of a cavity under the boiler and connected to a blower 15 fixed preferably on the frame of the hopper.

This air admitted into the burner may be fresh air from outside the boiler or air heated by the passage through a compartment located beneath the burner.

In the inlet zone of the burner, a guiding part 16 preferably made of stainless steel, comprises grooves (three being illustrated) in which fingers 17 of the same cross-section as the grooves are integral and reciprocate with piston 6.

On each feed movement of the piston, the fingers simultaneously slide on the bottom of the burner over about 4/5 of its length; in their reciprocating movement they crush the fuel product and poke the fire. The guiding part 16 prevents the embers, during retraction, from making their way into the feed channel 7, while during the thrust movement, the fingers stir up the combustion and progressively drive the burned residues out of the burner to the ashpan.

The entire burner is fixed by stainless bolts 18 on the lower compartment 19 of the boiler (FIG. 2).

According to FIG. 1, the boiler is specially designed for the best use of the above described advantages and characteristics of the feed system and the burner.

The boiler is of the known type with vertical tubular exchangers 20 made of steel and immersed in a water cylinder 21 placed above circular firebox 22.

The exchanger tubes are equipped with smoke dampers 23.

A removable domed deflector 24 of stainless steel, whose cavity may be filled with refractory materials for increasing the thermal inertia, is placed in the center of the firebox between the burner 8 and the inlet of the exchangers which constrains the flames from contacting the vertical walls of the firebox and distributes combustion gases in the exchangers. This new design of the deflector constitutes a characteristic of the invention.

The upper part of the exchangers opens into a smoke exhaust compartment permitting additional heat exchange above the water cylinder.

The lower compartment 19 encloses the ashpan drawer 25. An insulated door of large dimensions permits access to the ashpan and disassembly of the burner.

Figure 3:
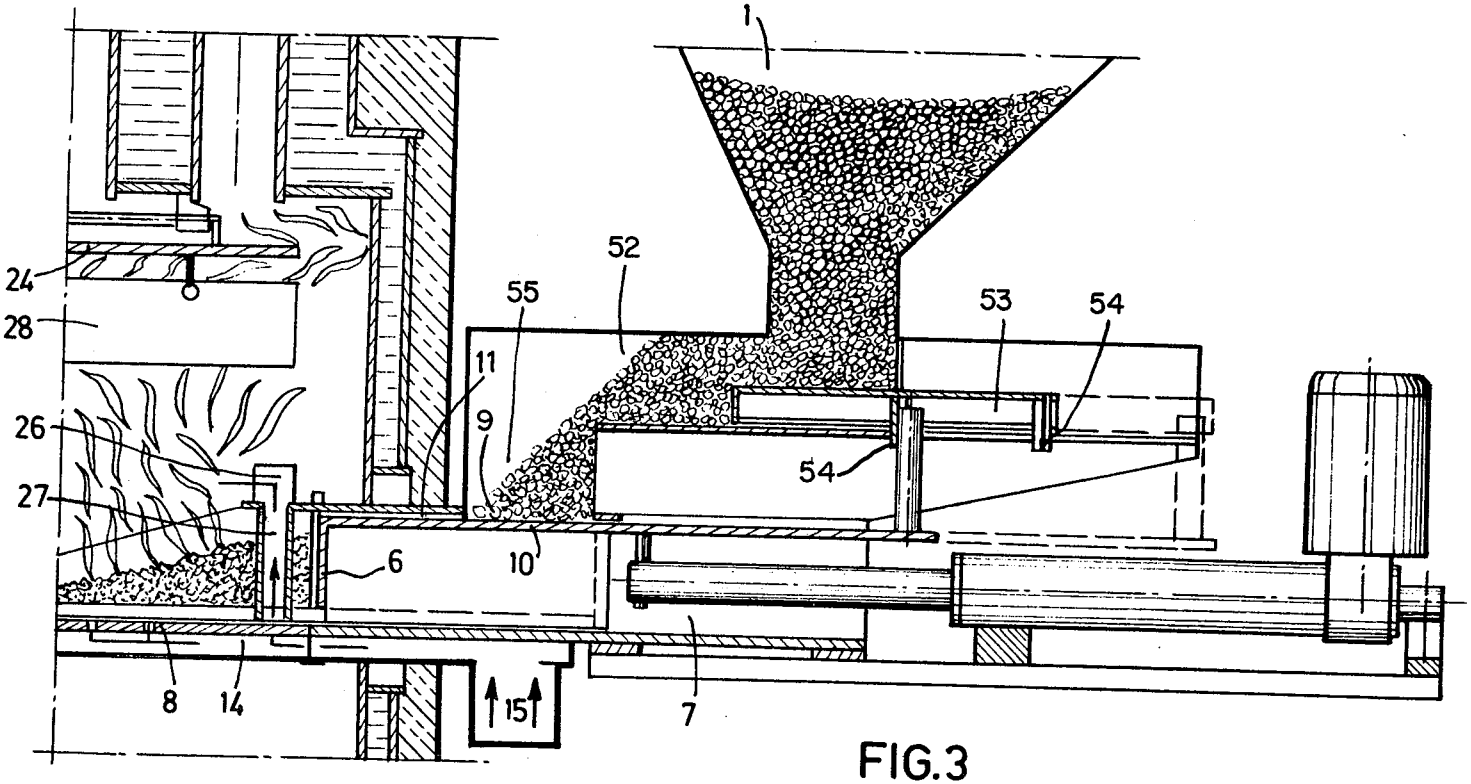
FIG. 3 is a cross-sectional view of the fuel hopper and the double piston feeding device of a variant of the preceding boiler.

According to a modification, illustrated in FIG. 3, the feed mechanism comprises, an upper prefeeding channel 52, at the base of hopper, inside which travels a plunger 53 which has a configuration which provides a space between its upper surface and the top of channel 52, permitting it to traverse, without jamming. The movement of the plunger 53 is transmitted by piston 6, limited by abutments 54. The forward movement of the plunger drives the fuel toward a cavity 55 which communicates with the channel 7.

When piston 6 is in the rest position, or forward end of stroke, its horizontal shelf 10 acts as the bottom of the cavity 55 and receives a metered amount of the fuel driven by plunger 53.

The cross-section of piston 6 corresponds, except for operational clearance, to the section of the channel 7 in which it is displaced.

At the end of the forward stroke, piston 6 is positioned at the inlet of burner 8 and completely closes off this orifice.

In the rearward movement of piston 6, shelf 10 is retracted and thus completely opens the base of the cavity 55. A metered amount of fuel contained in this cavity falls by gravity into channel 7, in front of the piston, while the plunger 53 retracts to uncover the orifice of the hopper.

In the forward movement of the piston 6, piston drives the fallen fuel into channel 7 toward the burner. The forward movement of plunger 53 starts to proceed through the medium of forward abutment 54 shelf 10 has completely closed off the base of cavity 55. The plunger 53 once again drives a metered amount of fuel into this cavity.

The combination of component parts of the feed mechanism and the combustion activating blower 15 are mounted on a frame connected to the orifice of the burner 8 by bolts or other fastening devices.

The hopper 1 is mounted on adjustable feet (not shown) and its orifice is fitted into the upper opening of channel 52.

A second variant of the device described above concerns the improvement of the combustion in the firebox of the boiler.

Figure 4:
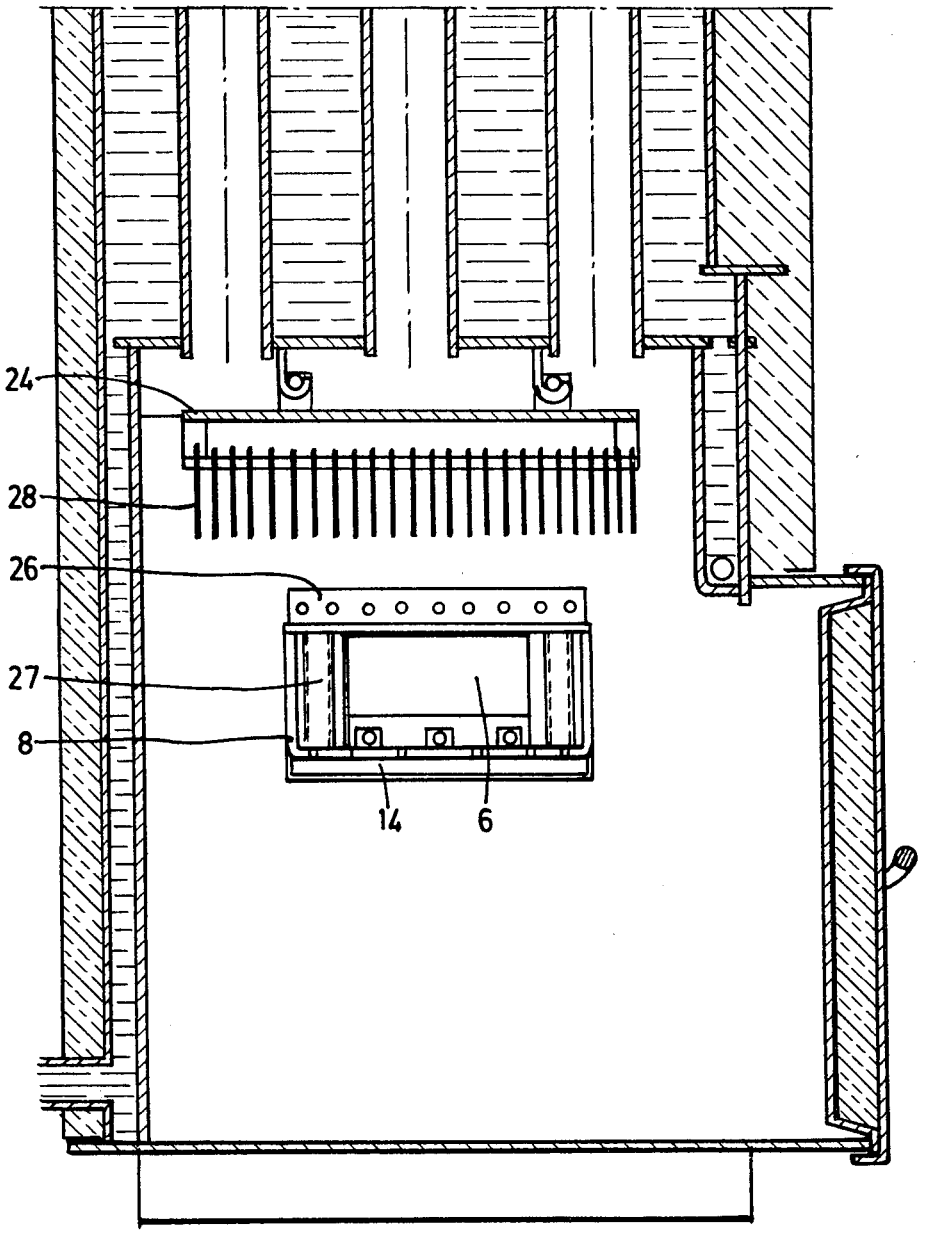
FIG. 4 is a cross-sectional view of the boiler of FIG. 3, showing, notably, the burner and the upper grate of the firebox.

A supply of air blown horizontally at the inlet side of the burner, by blower nozzle 26 (FIG. 4), is connected with the air admission cavity 14, located under the burner, by vertical tubes 27 placed to one side or the other of the inlet of the burner.

Under deflector 24, placed at the top of the firebox, a grate is formed with replaceable plates 28, of steel, cast iron or any other suitable material of high thermal inertia, through which the combustion gases flow and continue to burn.

These two combined devices permit a post-combustion of unburned gases and smoke, and avoid polluting smoke, premature fouling of the boiler and improve boiler output.

The boiler may be used for a central heating system as well as for any domestic or industrial hot water production.

What we claim is:

1. A hot water boiler which burns solid fuel in granular form comprising:

(1) a fire box with a combustion gas outlet, an opening at the bottom of said fire box to remove ashes, an orifice between said combustion gas outlet and said bottom opening, and a grate at orifice level;

(2) a hopper adjacent the exterior of said fire box for storing and discharging the solid fuel, including a discharge opening at the lower end of said hopper;

(3) an automatic feeder located under the discharge opening of said hopper comprising a reciprocating piston communicating with said orifice wherein said piston forms a fire barrier in the rest position by blocking said orifice and serves to close off said hopper;

(4) fingers integrally formed with said reciprocating piston, which project into said fire box through said orifice and poke the fire with each reciprocating movement; and (5) wherein said grate comprises grooves in which said fingers slide with each reciprocating move and poke said fire and discharge said burned residue through the grate toward said bottom of said firebox.

2. A hot water boiler according to claim 1 wherein said hopper at said discharge opening includes two baffles at least one of which is adjustable whereby the amount of fuel being discharged is limited as it falls by gravity in front of the reciprocating piston when in the retracted position which uncovers said discharge opening of said hopper.

3. A hot water boiler according to claim 1 wherein said piston is provided with a space between its upper portion and the bottom of said hopper to avoid jamming as the fuel is pushed into said fire box by said reciprocating piston.

4. A hot water boiler according to claim 3 in which said hopper also includes an abutment which removes fuel deposited on said piston upon the retraction of said piston from the orifice of the fire box.

5. A hot water boiler according to claim 1 further including a blower which feeds combustion air through the bottom of said grate.

6. A hot water boiler according to claim 1 further comprising an ash pan positioned below said grate and being sized and dimensioned so as to be capable of being withdrawn through said bottom opening of said fire box.

7. A hot water boiler according to claim 1 wherein said reciprocating piston includes a supplemental reciprocating piston mounted on top of said reciprocating piston to assist in the discharge of the solid fuel from said hopper.

8. A hot water boiler according to claim 1 wherein a dish-shaped high thermal inertia deflector is positioned in said fire box above said orifice.

9. A hot water boiler according to claim 1 wherein said fire box further includes a high thermal inertia deflector placed above said orifice in said fire box, said deflector comprising replaceable, hanging rectangular sheets.

* * * * *